US006042098A

United States Patent [19]

Kubota et al.

[11] Patent Number: 6,042,098

[45] Date of Patent: Mar. 28, 2000

[54] SHEET POST-PROCESSING APPARATUS

[75] Inventors: Kazuyuki Kubota; Hideki Mimura, both of Yamanashi-ken, Japan

[73] Assignee: Nisca Corporation, Minamikoma-gun, Japan

[21] Appl. No.: 09/088,090

[22] Filed: Jun. 1, 1998

[30] Foreign Application Priority Data

May 30, 1997 [JP] Japan ..... 9-157598

[51] Int. Cl.[7] ..... B65H 33/04; B65H 29/00

[52] U.S. Cl. ..... 270/58.02; 270/58.04; 270/58.07; 270/58.08; 270/58.14; 271/186

[58] Field of Search ..... 270/58.02, 58.04, 270/58.07, 58.08, 58.14; 271/186

[56] References Cited

U.S. PATENT DOCUMENTS

| | | | |
|---|---|---|---|
| 4,720,033 | 1/1988 | Olesen | 227/131 |
| 5,083,760 | 1/1992 | Yamazaki et al. | 270/53 |
| 5,137,265 | 8/1992 | Sato et al. | 270/53 |
| 5,363,175 | 11/1994 | Matysek | 355/208 |
| 5,709,376 | 1/1998 | Ushirogata | 270/58.11 |

FOREIGN PATENT DOCUMENTS 6-135620 5/1994 Japan .

*Primary Examiner*—Christopher P. Ellis
*Assistant Examiner*—Kenneth W Bower
*Attorney, Agent, or Firm*—Armstrong, Westerman, Hattori, McLeland & Naughton

[57] ABSTRACT

A post-processing apparatus for detecting the leading or trailing edges, turning over at a turn-over route, stapling, punching, or otherwise finishing sheets sequentially discharged from an image forming machine. The sheet post-processing apparatus is capable of consistently binding or punching holes for filing stacks of sheets at a predetermined side of the stack regardless of the side onto which an image is formed.

14 Claims, 5 Drawing Sheets

SHEET POST-PROCESSING APPARATUS

BACKGROUND OF THE INVENTION

1. Field of the Invention

The present invention relates to a sheet post-processing apparatus which is capable of binding or punching holes in stacks of sheets after images are formed by an image forming machine, such as a copy machine, printer or digital printing apparatus, and the present invention also relates to image forming machines which use this type of sheet post-processing apparatus.

2. Description of the Related Arts

It is a well known concept in the art for copying machines and printers to transfer either an image from a series of sheets or electronic data to the surface of paper media, and to discharge that media in a predetermined order, one sheet at a time, from a discharge exit located on such machines. It is also a widely know concept for a finishing apparatus to automatically bind a stack of a series of related sheets for which image transfer has been completed using a stapling device or other binding material or to automatically punch holes in a stack of sheets for the ease of filing.

In systems described in U.S. Pat. No. 5,083,760 (hereinafter "U.S. '760") and U.S. Pat. No. 5,137,265 (hereinafter "U.S. '265"), sheets are sequentially ejected in a specified order from a well known type of finisher to a discharge side where the stack is bound using a stapler activated by a signal indicating that a predetermined number of a stack of sheets has been completed. In such systems as taught in U.S. '760 and U.S. '265, sheets that are discharged out of an image forming machine are temporarily stacked in a first tray for the stapler. After binding the stack using the stapler, this stack of sheets is then discharged to a second tray for stacking the stapled sheets.

A binding mechanism is taught in U.S. Pat. No. 4,720,033 (hereinafter "U.S. '033").

Japanese Laid Open Patent Tokkai Hei 6-135620 (hereinafter "JP '620") describes a system in which a series of sheets can be bound by a stapler at the same time as holes are automatically punched through the stack of sheets. It is well known in the art for a system to include a mechanism along the passage of the sheets discharged from an image forming machine to a tray to punch holes in those sheets and it is also well known to punch holes at the same time as binding a stack of sheets that have been fed sequentially for the purpose of binding.

Nonetheless, these types of image forming systems do not effectively respond to the following problems of a finisher, which result from the forming of an image either on one side or on both sides of the paper sheets.

There is a problem of images being formed by an image forming machine on one and both sides of the paper sheets and that such original documents can and often do exist in the same stack for copying. As these single and double-sided sheets are discharged from the image forming machine, the correct hole punching positions and the binding positions of a stapler become opposed resulting in an incorrect finishing of the stack.

To explain in more detail, a first sheet is processed with an image on only one of its sides, and for purposes of this explanation we shall call that first side the front side. Directly following in sequential order is another sheet with images formed on both sides, or in other words, on its front and back sides. When both sheets are discharged from the image forming machine, one sheet will be positioned to have holes punched in its right side while the other will be positioned to have holes punched in its left side.

This kind of problem occurs when single sheets are processed with an image on one and on both sides. The problem of having holes punched on both sides, namely the left and right sides, exists when using the systems in the U.S. '760, U.S. '033 and JP '620.

SUMMARY OF THE INVENTION

It is an object of the present invention to solve the above-described problems of the prior art. The present invention is capable of consistently binding or punching holes for filing stacks of sheets at a predetermined side of the stack regardless of the side onto which an image is formed. In other words, sheets can be discharged from the image forming machine with an image formed on their front, back or on both sides.

It is an object of the present invention to offer a simple construction of a compact size.

It is also an object of the present invention not only to bind a stack of documents, but also, at the same time, to offer an apparatus which is capable of punching holes into the stack as needed to allow for later filing of that stack.

The present invention is composed of the following structure in order to achieve the above-described objects.

A paper transfer direction turn-over route for turning over pages to switch their front and back edges in the forward direction is established for sheet transfer. An inlet deflector means is established mid-way in the transfer passage to switch the direction of the paper traveling through the passage to be turned over or to be transferred to the tray means for stacking sheets of paper to be stapled after having been discharged from the image forming machine. Binding the sheet consistently at a predetermined position is made possible by selecting, as needed, to transfer the paper discharged from the image forming machine to the turn-over route or to the straight transfer route to accommodate the image formation on the front and back of sheets that are being transferred to the tray means.

The inlet deflector means can be controlled either by command signals issued from the image forming machine or by commands that can be input manually by an operator.

The paper hole punching means can be located either upstream of the paper direction turn-over route or down-stream of the same. If the hole punching means is located up-stream of the turn-over route, the commands will switch between punching holes in the leading edge of sheets being fed or punching holes in the trailing edge of sheets. The hole punching means will employ a paper sensor upstream of the paper direction turn-over route so that if punching a hole in the right side of the paper, for example, holes will be punched at a position after a predetermined amount of transfer of the paper after the signal detecting its leading edge. If holes are being punched at the left edge, for example, holes are punched at a position after a predetermined amount of transfer after detecting the trailing edge of the paper. In this case, holes can be punched in either the left or right sides of the sheets after transferring the paper by a predetermined amount based on the signal detecting the leading edge of the sheet.

BRIEF DESCRIPTION OF THE DRAWINGS

FIGS. 2(A), 2(B) and 2(C) are chronologically-oriented drawing figures of hole punching on the leading edge of the sheet, wherein FIG. 2(A) illustrates the leading edge of the sheet being detected by the sensor, FIG. 2(B) illustrates the preparation for punching holes, and FIG. 2(C) illustrates the punching of holes.

FIGS. 3(A), 3(B), and 3(C) are also time-oriented drawing figures of hole punching on the trailing edge of the sheet, wherein FIG. 3(A) illustrates the trailing edge of the sheet being detected by the sensor, FIG. 3(B) illustrates the preparation for punching holes, and FIG. 3(C) illustrates the punching of holes.

DESCRIPTION OF THE PREFERRED EMBODIMENTS

Figure 1:
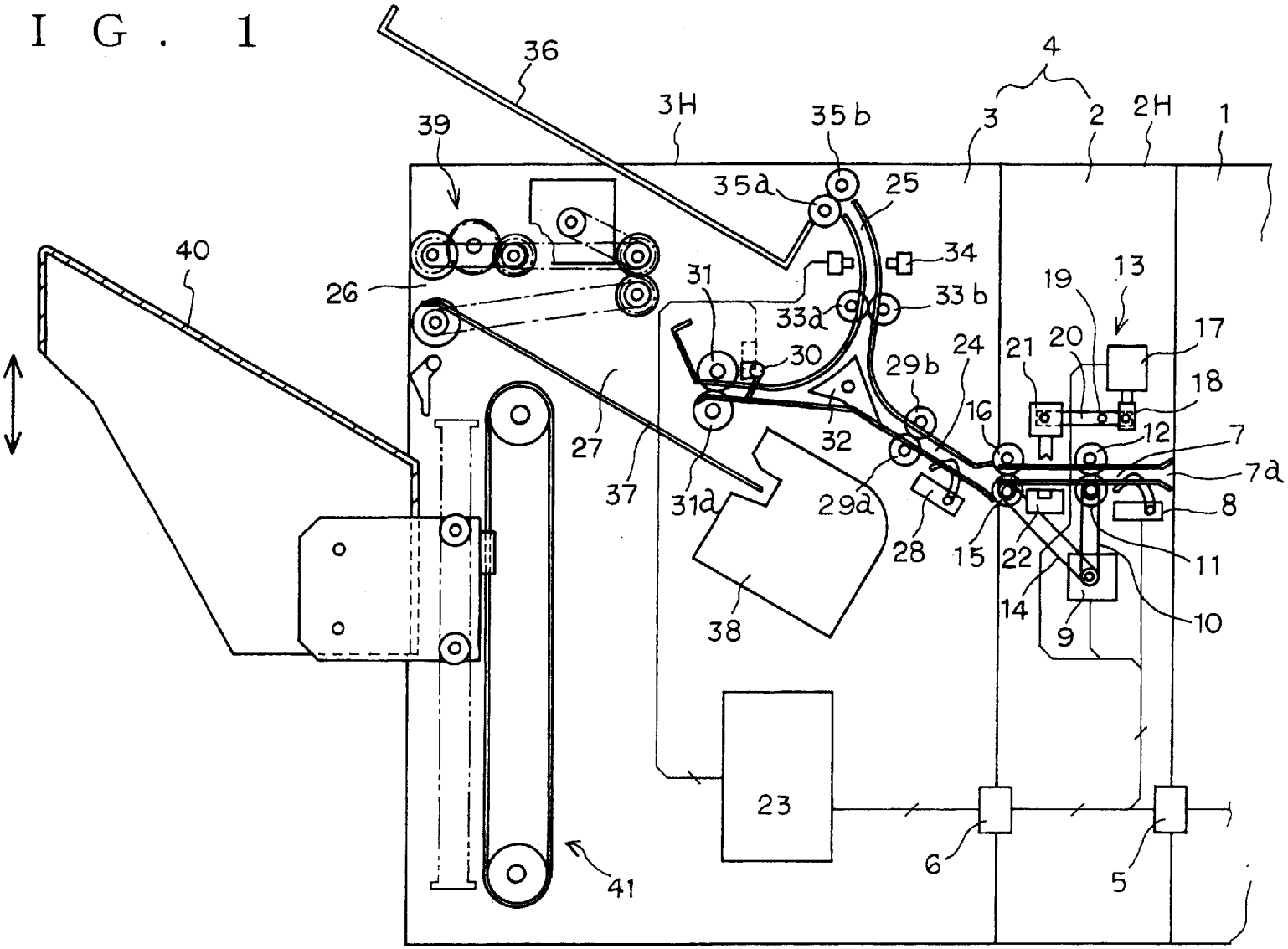
FIG. 1 is a cross-sectional view of the sheet post-processing apparatus.

The following describes the preferred embodiment of a sheet post-processing apparatus in the present invention as used with a copying machine based on the figures provided.

In the figures, reference numeral 1 represents a copy machine, reference numeral 2 represents an external apparatus, and reference numeral 3 represents a discharge device having a stapling function. The external apparatus 2 and discharge device 3 comprise the sheet post-processing apparatus 4. Copying machine 1, external apparatus 2 and discharge device 3 are connected by interfaces 5 and 6.

External apparatus 2 includes: a transfer passage for transporting sheets in a housing 2H, discharged from the copying machine 1, to the discharge device 3 taking sheets from inlet 7*a*; a sensor 8 established at the transport inlet 7*a* of the transfer passage 7; a drive motor 9; a belt 10, rotating by the drive of the drive motor 9, to drive a transport drive roller 11; a guide roller 12, rotated by contact with the transport drive roller 11; a hole punch means 13, for punching holes in sheets in the transfer passage 7; and a rotating belt 14, driven by the drive motor 9, to both rotate the discharge drive roller 15 and to transport the drive roller 15 by contact with a discharge roller 16.

The sensor 8 detects the leading or trailing edges of a sheet S sent to the transfer passage 7 according to the mode and function of the automatic document feeder apparatus or copying machine 1 (only a portion of which is shown in the drawing figures).

The hole punching means 13 comprises: a drive unit 17; a retractable drive arm 18 which retracts into the drive unit 17; a link arm 20, pivoting on pin 19, to move punch 21 up and down by the retracting and extracting action, respectively, of drive arm 18, wherein punch 21 moves up and down by the movement of the link arm 20 and a stock 22, which is positioned below the punch 21. By providing two punch means 21 and stock 22 in the width direction of the sheet S, two holes can be punched in the width direction of the sheet S.

The result of sheet detection by sensor 8 is output to the control device 23 built into discharge device 3 which controls the drives of drive motor 9 and drive unit 17. Also, as shown in FIG. 2(A), the pitch H1, between the hole opening position of the hole punching means 13 and sensor 8, is larger than the margins H2 and H3 for hole punching positions from the leading edge of the sheet S or from the trailing edge of the sheet S when punching holes in the sheet S.

The control device 23 switches between the sheet leading edge or the sheet trailing edge detection methods for sensor 8 based on the data output from the copy machine 1. Control device 23 adds the amount of the margin H2 to the pitch H1 when using the first mode to punch holes in the leading edge of sheet S and the control device 23 subtracts the amount of the margin H3 from the pitch H1 when using the second mode to punch holes in trailing edge of sheet S. Drive of motor 9 is stopped at the same time that drive 17 is driven to punch the holes based on each of these calculations. In other words, the control device 23 switches the hole punching position for the leading or trailing edge of the transfer direction of the sheet S for which the non-turn-over route or the turn-over route in the transfer passage has been selected.

In a housing 3H, the discharge device 3 comprises: a transfer route 24 for transporting sheets discharged from the external device 2; a sheet turn-over route 25 which is branched mid-way through the transfer route 24; and a discharge processing path 27 which leads to a discharge outlet 26 from the transfer route 24.

The transfer route 24 comprises: a sheet sensor 28 for detecting the sheet discharged from the external apparatus 2; transport rollers 29*a* and 29*b* for transporting a sheet; a count switch 30 for counting the number of sheets; and discharge rollers 31*a* and 31*b*.

An inlet deflector 32 is established at the inlet to the reversing route 25 to cause sheets to be fed to either the reversing route or to the transfer route 24. The transfer direction of the sheet S is selectively switched to cause the sheets to travel either into the turn-over route or to travel into the non-turn-over route, both of which are located in the sheet transfer passage. Control of the inlet deflector 32 is done either by a command signal sent from the copy machine 1 or by a button switch for an operator to control the selection of either the non-turn-over route or the turn-over route. The turn-over route 25 comprises: transport rollers 33*a* and 33*b*; a switch back sensor 34; switch back rollers 35*a* and 35*b*; an inclined auxiliary tray 36 (non-stapling tray) having a bottom edge which is situated so as to be below rollers 35*a* and 35*b* and which is capable of holding discharged processed sheets.

The discharge processing path 27 comprises: an inclined support tray 37 (tray means) directed towards the discharge outlet 26; a sheet binding device 38 (stapling means) positioned at the lower end of the support tray 37, wherein the discharge rollers 31*a* and 31*b* feed sheet S to the discharge outlet 26 and stacks of sheets, processed at sheet binding device 38, are discharged to the vertically movable discharge tray 40 (storage tray) by the discharge means 39.

Drives of transport rollers 29*a* and 29*b*, discharge rollers 31*a* and 31*b*, a path switching device 32, transport rollers 33*a* and 33*b*, switch back rollers 35*a* and 35*b*, a binding device 38, a discharge means 39 and vertically moving device 41 are controlled by the control device 23 based on detected signals from the sheet sensor 28, the count switch 30 and the switch back sensor 34 to correspond appropriately to the mode of the pre-processing apparatus.

Figure 4:
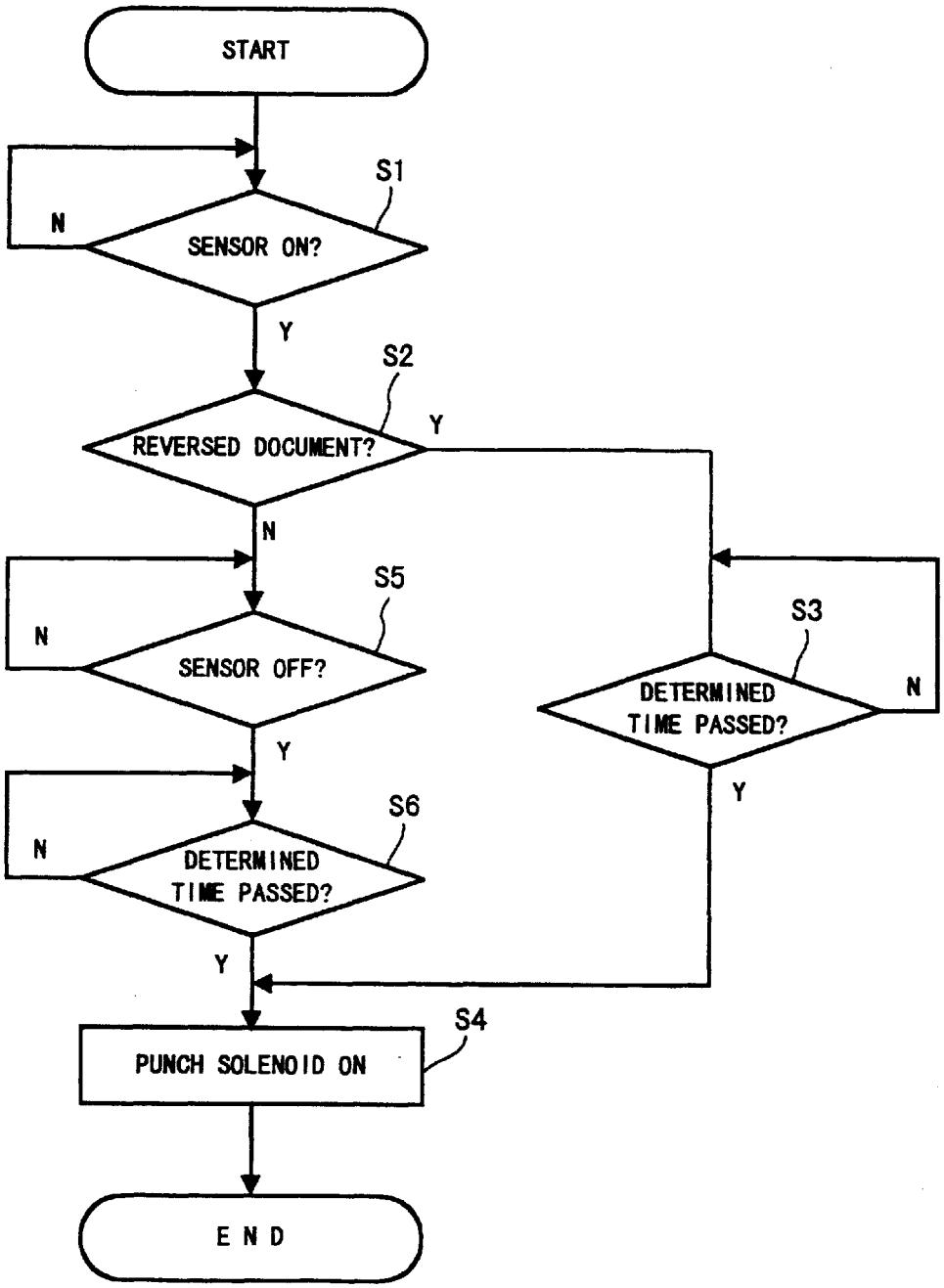
FIG. 4 is a process flow chart supplementing FIGS. 2 and 3.

In such a construction, punching holes in a situation where a stack of sheets is set onto an automatic document feeder apparatus so that the tops and bottoms of the sheets are reversed and image processed sheets are discharged in order to be facing upwardly as illustrated in FIG. 2(A), the leading edge of the sheet S, discharged from copy machine 1, is detected by sensor 8 (see S1 in FIG. 4). The sensor 8 determines that the direction of the sheet is reversed (see S2 in FIG. 4), as shown in FIG. 2(B), after a predetermined amount of time (see S3 in FIG. 4), the sheet S extends over both the drive roller 11 and the transport driven roller 12 along with both the transport drive 15 and the discharge driven roller 16, whereby both the transport drive roller 11 and the transport drive roller 15 stop and the punch 21 is lowered to punch holes (for left side binding) in the sheet S by the drive of the drive unit 17 as shown in FIG. 2(C) (see S4 in FIG. 4).

If stapling occurs along with the punching of holes, the sheet is transported to turn-over route 25, mid-way of the transfer passage 24, by the transport rollers 29*a* and 29*b*, by the drive of the inlet deflector means 32. Part of the sheet is externally exposed by the switch back roller 35*a* and 35*b* and by detection of the trailing edge of the sheet by the switch back sensor 34. The rotating direction of switch back rollers 35*a* and 35*b* is reversed to return the sheet S back to the turn-over route 25 via the transfer passage 24 and the sheet S is placed on the support tray 37 by the drive of discharge rollers 31*a* and 31*b*. At this point, sheets gravitate to the lower end of the support tray 37 and abut a binding device 38. The holes in the sheets received on the support tray 37 are arranged on the stapling side.

When a predetermined number of sheets have been counted by the counter switch 30, the binding device 38 operates to bind the stack of sheets set on the support tray 37 after which said sheets are discharged to the discharge tray 40 via the discharge outlet 26 by the drive of discharge means 39.

The following explains punching holes in a situation where a stack of sheets is set onto an automatic document feeder apparatus where the tops and bottoms of the sheets are reversed and image processed sheets are discharged in order to be facing downwardly. The leading edge of a sheet discharged from the copy machine 1 is detected by sensor 8 (see S1 in FIG. 4). If it is determined that the sheet is not facing in the reverse direction (see S2 in FIG. 4) as shown in FIG. 3(A), the trailing edge of the sheet S, discharged from copy machine 1, is detected by sensor 8 (see S5 in FIG. 4) as shown in FIG. 3(B), after a predetermined amount of time (see S6 in FIG. 4), the sheet S extends over both the drive roller 11 and the transport driven roller 12 along with both the transport drive 15 and the discharge driven roller 16, whereby both the transport drive roller 11 and transport drive roller 15 stop and the punch 21 is lowered to punch holes (for left side binding) in sheet S by the drive of drive unit 17, as shown in FIG. 3(C) (see S4 in FIG. 4).

If stapling occurs along with the punching of holes, the sheet S is transported to the transfer passage 24 by the drive of the discharge rollers 31*a* and 31*b* and then the sheet S is set on the support tray 37. At this point, sheets gravitate to the lower end of the support tray 37 and abut the binding device 38.

When a predetermined number of sheets have been counted by the counter switch 30, the binding device 38 operates to bind the stack of sheets set on the support tray 37, after which the sheets are discharged to the discharge tray 40 via the discharge outlet 26 by the drive of the discharge means 39.

It is in this way that it is possible to punch holes or to bind stacks of sheets using the same apparatus regardless of the orientation of the sheet S discharged from either a copy machine 1, which employs various discharge environments, or from an automatic document feeder device. Therefore, the present invention is a widely applicable and highly adaptable sheet post-processing device 4.

Figure 2:
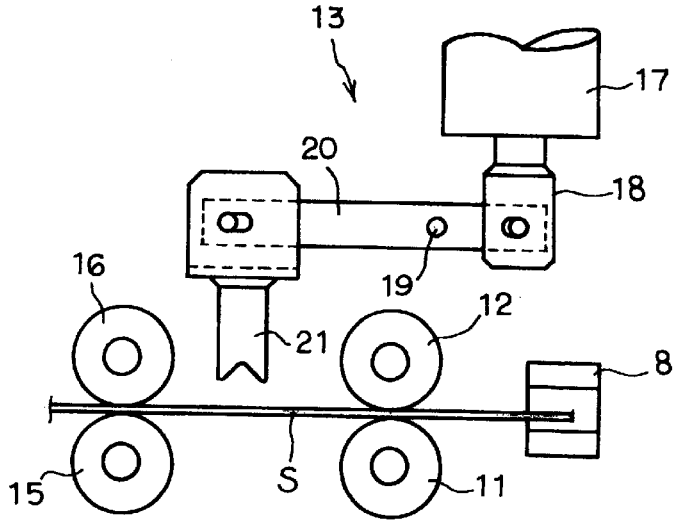
Figure 2:
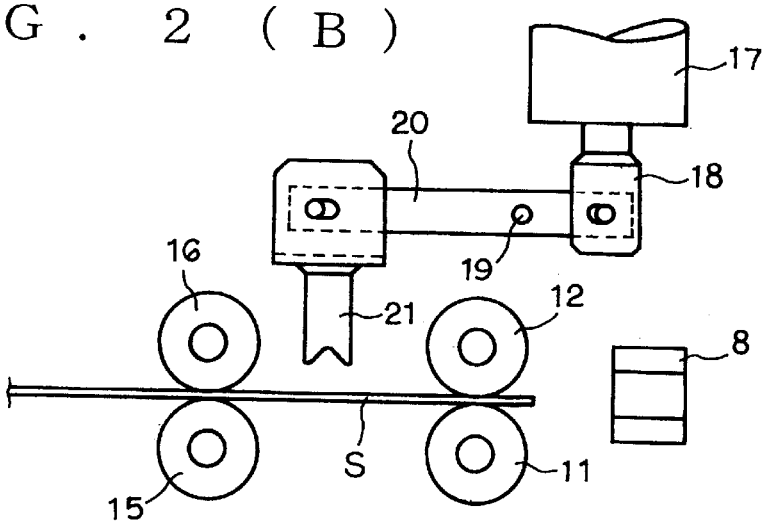
Figure 2:
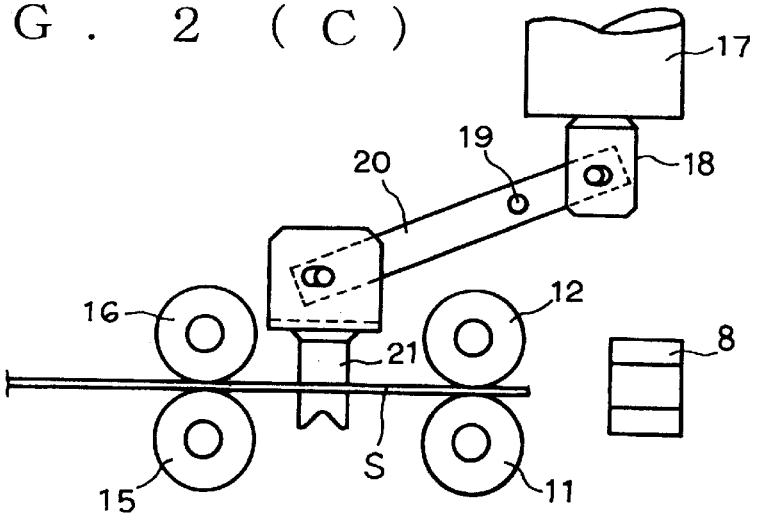
Figure 3:
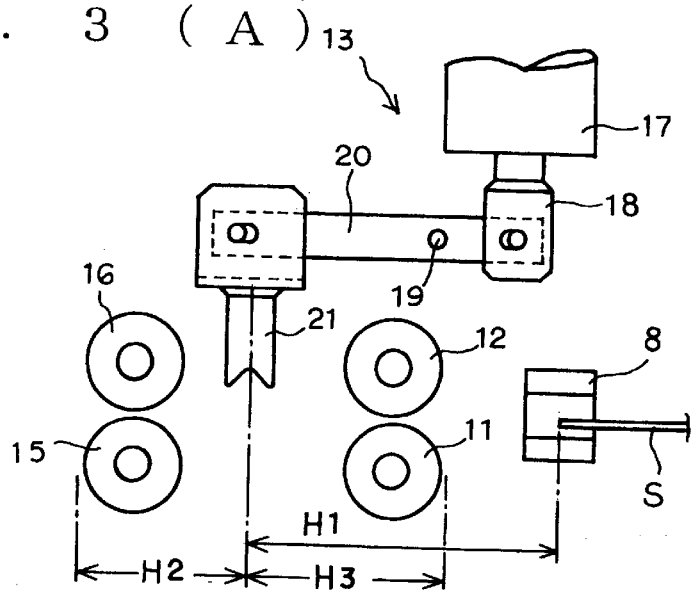
Figure 3:
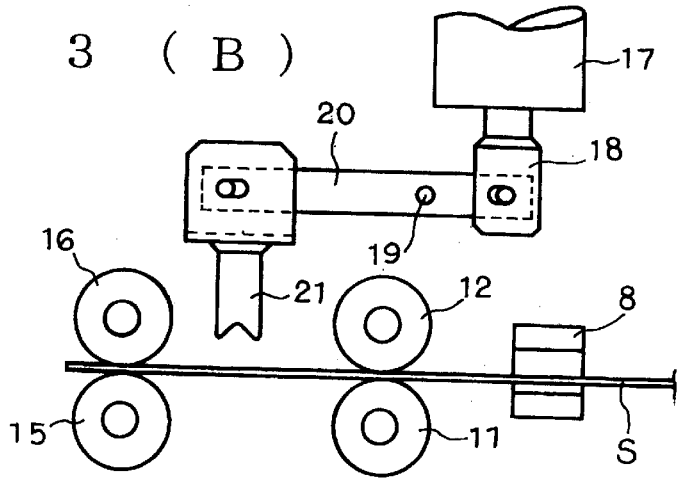
Figure 3:
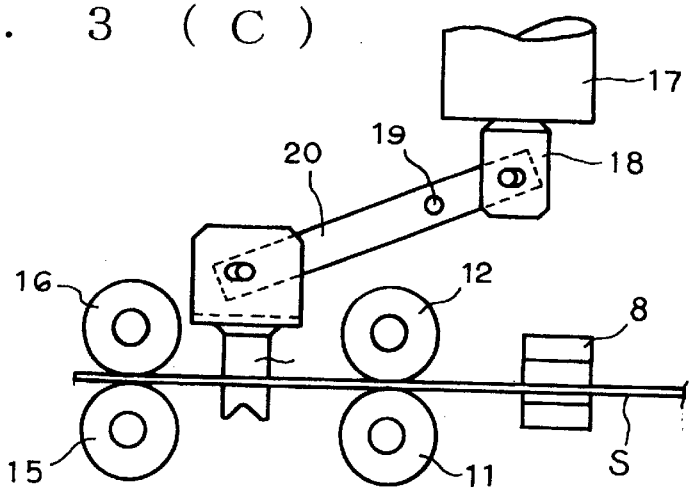

Also, when copying on one side of a sheet S using a copy machine 1, either the situation of FIG. 2 or FIG. 3 will suffice, and when copying on both sides of a sheet S, either the situation of FIG. 2 or FIG. 3 will suffice to reverse the direction of the binding side of the sheet S.

Therefore, punch processing can be employed regardless of the copying mode of the copy machine 1.

Figure 5:
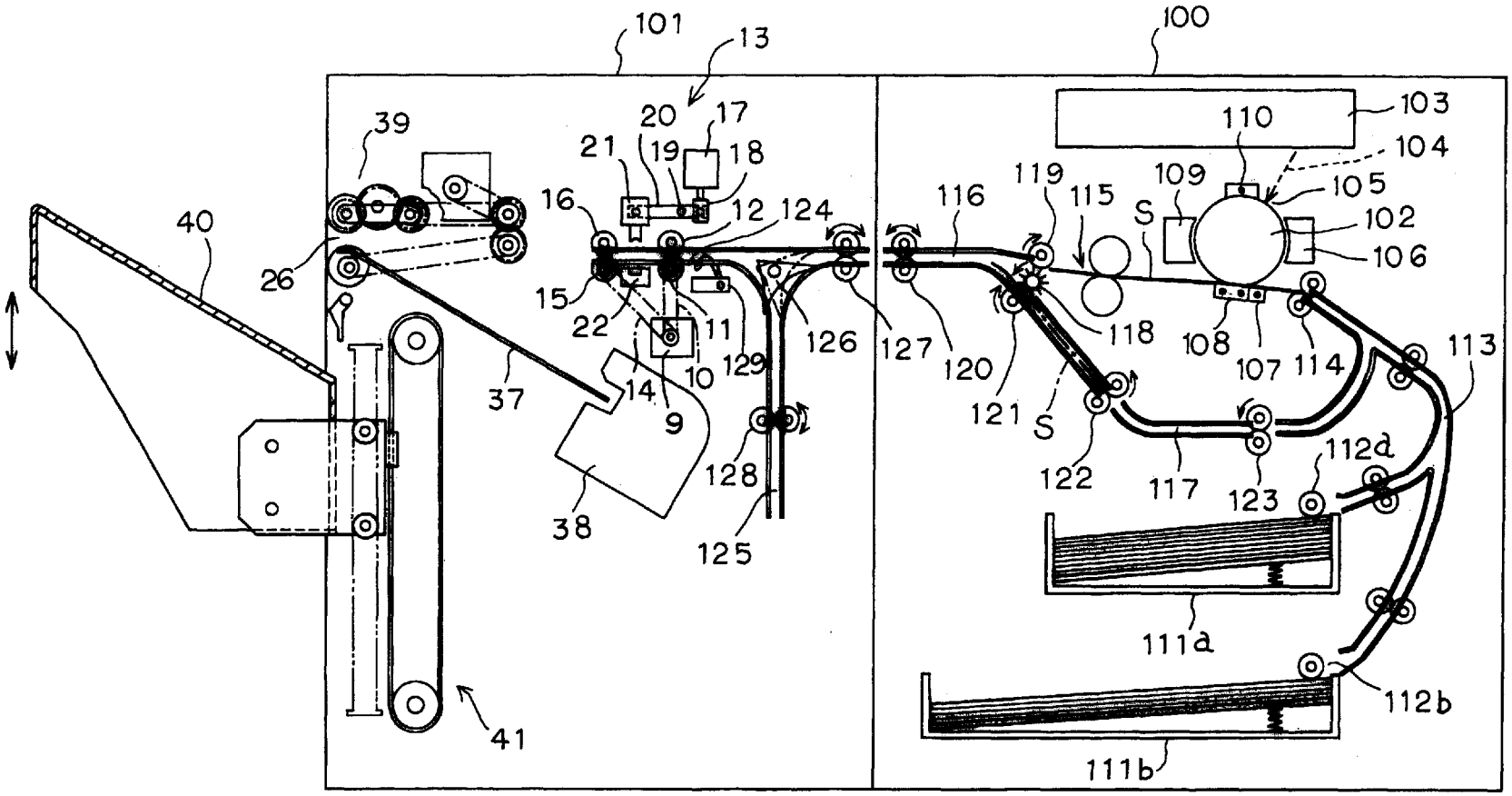
FIG. 5 shows another embodiment of the present invention.

Next, we will explain another possible embodiment of the present invention as shown in FIG. 5.

In the embodiment of FIG. 5, a sheet post-processing apparatus 101 is joined to an image forming machine such as a double-sided copying machine 100.

The double-sided copying machine is equipped with a means for transferring images to both sides of a sheet. The double-sided copying machine has a photosensitive drum 102 and near the photosensitive drum 102 is an optical unit 103. The optical unit has, in numerical order, an exposure unit 105 which reflects optical information 104; a developer 106 which adheres toner to the electrostatic image formed on the exposure unit 105; a transfer mechanism 107 for transferring the toner image to the sheet; an anti-static device 108 to peel the image transferred sheet from the photosensitive drum 102; a cleaner 109 to remove residual toner and electric load from the photosensitive drum 102; and an anti-static mechanism 110 to remove static electricity from the photosensitive drum 102.

A double-sided copying machine 100 is equipped with: paper supply cassettes 111*a* and 111*b* in which sheets for image transfer are stored; paper separator means 112*a* and 112*b* for sequentially feeding single sheets from the paper supply cassettes 111*a* and 111*b*; a paper supply route 113 wherein sheets are separated and fed sequentially by the paper separator means 112*a* and 112*b*; a positioning roller 114 for positioning the toner image on the photosensitive drum 102; a fixer 115 for heat fixing of the sheet separated from the photosensitive drum 102 by an anti-static device 108; a sheet discharge route 116 for discharging sheets having images which have been fixed; and a back side transfer passage 117 for supplying double-sided sheets (only one side of which has been processed) to the paper supply route 12.

Fixed sheets are supplied by an impeller 118 and a roller 119 in discharge route 116. Discharge route 116 comprises a forward and reverse roller 120. Sheets are supplied to the sheet post-processing apparatus by the forward rotation of the roller 120 and sheets are supplied to the transfer passage 117 for double-sided processing by a reverse rotation of the roller 120.

The transfer passage 117, for double-sided processing, is equipped with an urging roller 121 that physically contacts the impeller 118 and transfer rollers 122 and 123. When the trailing edge of a sheet reaches the point between the impeller 118 and the forward and reverse rollers 120, the trailing edge of the sheet is guided to between the impeller 118 and the urging roller 121 by the reverse rotation of forward and reverse rollers 120. The trailing edge of the sheet is then supplied to the positioning roller 114 by the transfer rollers 122 and 123.

The double-sided copying machine 110 is designed to transfer sheets with a consistent center for all media, regardless of the length of the media in the width direction. In other words, the copy machine is based on a centering system.

The sheet post-processing apparatus includes: a transfer passage 124; a sheet turn-over transfer route 125 for turning over sheets; an inlet deflecting means 126 for switching the transfer route of the sheet to either the transfer route 124 or to the turn-over transfer route 125 in order to reverse the direction of the front and back edges of the sheets; a support tray 37; stapling means 38; discharge means 129; a discharge outlet 26; a discharge tray 40; and a raising and lowering device 41.

The transfer route 124 has; forward and reverse roller 127; a sheet detection sensor 129; a drive motor 9; a belt 10; a transfer drive roller 11; a transfer guide roller 12; a hole punching means 13; a belt 14; a discharge drive roller 15; a discharge guide roller 16; and turn-over route 125 having a forward and reverse roller 128.

Hole punching means 13 has a punch 21 and a stock 22 on both sides of the center in the width direction of the sheets. Therefore, holes can consistently be punched into both sides of the center position of the sheets regardless of the size of the sheet in the width direction.

The double-sided copy machine 100 is equipped with a mode selecting means on a control panel (not shown) either for selecting a single side mode for transferring images to only one side of the sheet or for selecting a double side mode for transferring images to both sides of the sheet. Also, by a control means (not shown), a signal from a mode setting means operates the inlet deflecting means 126 to turn-over the sheet so that the front and back edges are reversed. Otherwise, the double-sided copy machine 100 has the same structure as the copy machine 1 of FIG. 1, which is only partially shown.

In such a structure, if a single sided copy is selected, the inlet deflecting means 126 switches to the direct transfer route by the mode setting means. In this situation, sheet S, fed from one of the paper supply cassettes 111*a* or 111*b*, passes paper transfer route 113 and reaches positioning roller 114. After positioning the toner image on the photosensitive drum 102, the sheet S is transferred to the copy machine 107. The copy machine 107 transfers and adheres the image on the photosensitive drum 102 to the sheet.

The sheet S, having a toner image transferred the room, is peeled from the photosensitive drum 102 by an anti-static device (i.e. pair of positioning rollers 114) and the sheet is then sent to a fixer 115 for heat-fixing.

The sheet S, now having the toner image heat-fixed thereon, is then moved to between the impeller 118 and the roller 119. The sheet is supplied to transfer route 124 on the sheet post-processing apparatus 101 by the forward and reverse roller 120.

When the trailing edge of the sheet is supplied to the transfer route 124, hole punching means 13 punches a hole in the sheet after a predetermined amount of additional transfer and the sheet is discharged to the support tray 37. When a predetermined number of sheets have accumulated in the support tray 37, stapling means 38 binds the stack of sheets and paper discharge means 39 discharges the stack of sheets to the discharge tray 40.

If the double-sided mode has been selected, a signal from the mode setting means switches the inlet deflecting means 126 to the position shown with dotted lines in FIG. 5. The leading edge of a single-sided image transferred sheet S passes inlet deflecting means 126 and travels into the turn-over route 125. When the trailing edge of the sheet S reaches a point between the impeller 116 and the forward and reverse roller 120, the forward and reverse roller 120, and other forward and reverse rollers 127 and 128 reverse their rotation to switch back sheet S. The trailing edge of the sheet S is guided to between the impeller 116 and the roller 121 for drawing sheets in and the sheet is supplied to the transfer route 117 for turning over the sheet. The sheet S, supplied to transfer route 117 (shown as a dotted line in FIG. 5), is moved to the positioning rollers 114 by transfer rollers 122 and 123.

Because the sheet performs a U-turn, the sheet is moved to between transfer device 107 and photosensitive drum 102 with its sides reversed. When the reversed sheet reaches photosensitive drum 102, a toner image on the photosensitive drum 102 is transferred to the sheet's back side. Next, it is moved onto the fixer 115, the image is heat fixed to the sheet, and the sheet passes between the impeller 118 and the roller 119. Forward and reverse roller 120 then supplies the sheet to the sheet post-processing apparatus 101. In this case, the inlet deflecting means 126 switches to the position indicated by the solid line in FIG. 5, and the sheet, which is copied on both sides, is supplied to the hole punching means 13. When sensor 129 detects the trailing edge of the sheet, a hole is punched by hole punching means 13, after a predetermined amount of additional transfer, as is the case with a single-sided copy just described, and the sheet is then discharged to the support tray 37. When a predetermined number of sheets have accumulated at the support tray 37, the stapling means 38 binds the stack and discharge means 39 discharges the bound stack to the discharge tray 40.

Thus, as shown in the embodiment of FIG. 5, because the hole punching means 13 can be established downstream of the turn-over route 125, holes can be punched in sheets by an additional amount of transfer after detecting the trailing edge of both single- and double-sided copy sheets by sensor 129.

What is claimed is:

1. A post-processing apparatus for sheets discharged from an image forming machine comprising:

a tray means for holding a stack of said sheets for stapling;

a transfer passage for sequentially transferring single sheets of paper discharged from an image forming machine to said tray means, wherein said transfer passage includes: a turn-over route for switching a direction of front and back edges of said sheets; an inlet deflecting means through which said sheets pass; and a non-turn-over route for said sheets that are not turned over;

a hole punching means located in said transfer passage;

a stapling means for stapling said stack of said sheets on said tray means, and a control means, of said inlet deflecting means, for selecting any one of said turn-over route for switching a direction of front and back edges of a sheet of said sheets and said non-turn-over route.

2. The sheet post-processing apparatus according to claim 1, further comprising a paper storage tray, differing from said tray means, for storage of a stack of bound sheets transferred from said tray means.

3. The sheet post-processing apparatus according to claim 1, further comprising a non-stapling tray for storage of said sheets.

4. The sheet post-processing apparatus according to claim 1, wherein a means for controlling said inlet deflecting means, to select any one of said turn-over route and said non-turn-over route, uses a signal transmitted from an input means or transmitted from an image forming machine.

5. The sheet post-processing apparatus according to claim 1, wherein said hole punching means is located downstream of said turn-over route in said transfer direction of said turn-over route and wherein holes are punched after said sheets are turned over during a turn-over mode.

6. The sheet post-processing apparatus according to claim 1, further comprising a hole punch position switching means to punch holes in any one of leading and trailing edges of said sheets according to said transfer direction of said sheets selected to travel via any one of said turn-over route and said non-turn-over route, wherein a hole punching means for said sheets is located in said transfer passage between an inlet for said sheets discharged from an image forming machine and said turn-over route.

7. The sheet post-processing apparatus according to claim 6, further comprising a first housing which includes said inlet, said hole punching means, and said paper sensor, and a second housing which includes said stapling means, and said tray means.

8. The sheet post-processing apparatus according to claim 6, wherein said hole punch position switching means further comprises a paper sensor located upstream of said hole punching means in said transfer direction and makes said hole punching means to work based on a signal from said paper sensor when said paper sensor detects any one of leading and trailing edges in said transfer direction of said sheets.

9. The sheet post-processing apparatus according to claim 8, wherein said hole punch position switching means uses said hole punching means to punch holes in both said leading edge of said sheets after transferring said sheets a predetermined amount based on said signal from said sensor of said leading edge of said sheets in said transfer direction and in said trailing edge of said sheets after transferring said sheets a predetermined amount based on said signal from said sensor of said trailing edge of said sheets in said transfer direction.

10. A post-processing apparatus for sheets discharged from an image forming machine comprising:

a tray means for holding a stack of said sheets for stapling;

a transfer passage for sequentially transferring single sheets of paper discharged from an image forming machine to said tray means, wherein said transfer passage includes a turn-over route switching a direction of front and back edges of said sheets, an inlet deflecting means through which said sheets pass and a non-turn-over route for said sheets that are not turned over;

a stapling means for stapling said stack of said sheets on said tray means; and a control means of said inlet deflecting means to select any one of said turn-over route for switching a direction of front and back edges of a sheet of said sheets and said non-turn-over route.

11. The sheet post-processing apparatus according to claim 10, further comprising a paper storage tray, differing from said tray means, for storage of a stack of bound sheets transferred from said tray means.

12. The sheet post-processing apparatus according to claim 10, further comprising a non-stapling tray for storage of sheets, wherein said non-stapling tray means differs from said tray means in said turn-over route.

13. An image forming system comprising:

a means for forming an image selectively on any one of one side and both sides of a sheet;

a means for setting a mode to select any one of forming an image on said one side and forming an image on said both sides of said sheet;

a discharge means for discharging a sheet onto which an image has been formed by said image forming means;

a tray means for holding a stack of sheets discharged by said discharge means to be stapled;

a transfer passage for sequentially transferring single sheets of paper discharged from an image forming machine to said tray means, wherein said transfer passage includes a turn-over route for switching a direction of front and back edges of said sheets, an inlet deflecting means through which said sheets pass and a non-turn-over route for said sheets that are not turned over;

a hole punching means located in said transfer passage;

a stapling means for stapling a stack of sheets on said tray means; and a control means of said inlet deflecting means to select any one of said turn-over route for switching a direction of front and back edges of said sheet and said non-turn-over route for sheets based on a signal from said means for setting a mode.

14. An image forming system according to claim 13, wherein said discharge means further comprises a means for selectively discharging sheets so that the centers of the sheets onto which an image has been formed coincide with one another.

* * * * *